US005346561A

United States Patent [19]

Obata et al.

[11] Patent Number: 5,346,561

[45] Date of Patent: Sep. 13, 1994

[54] SPHEROIDAL GRAPHITE CAST IRON MEMBER HAVING IMPROVED MECHANICAL STRENGTH HAND METHOD OF PRODUCING SAME

[75] Inventors: Fumio Obata; Hisashi Yasuda; Hideaki Nagayoshi, all of Kitakyusyu; Kiyoshi Suehara; Kouhei Imanishi, both of Fukuoka; Toshiki Yoshida, Tochigi, all of Japan

[73] Assignee: Hitachi Metals, Ltd., Tokyo, Japan

[21] Appl. No.: 22,623

[22] Filed: Feb. 25, 1993

[30] Foreign Application Priority Data

Feb. 27, 1992 [JP] Japan ..... 4-076299

[51] Int. Cl.[5] ..... C21D 5/00; C22C 37/04

[52] U.S. Cl. ..... 148/321; 148/902; 148/543

[58] Field of Search ..... 148/321, 543, 612, 902; 420/29, 13

[56] References Cited

U.S. PATENT DOCUMENTS 3,860,459 1/1975 Thomas et al. ..... 148/321
4,990,194 2/1991 Obata et al. .

FOREIGN PATENT DOCUMENTS 51-123719 10/1976 Japan .
53-73413 6/1978 Japan .
64246 1/1989 Japan .
2290943 11/1990 Japan .

*Primary Examiner*—Deborah Yee
*Attorney, Agent, or Firm*—Sughrue, Mion, Zinn, Macpeak & Seas

[57] ABSTRACT

The spheroidal graphite cast iron member having a surface layer portion mostly composed of a ferrite phase and having a thickness of at least 1 mm, and an inner portion composed of a pearlite phase and a ferrite phase, the surface layer portion having a ferritization ratio of 70% or more which is larger than that of the inner portion by at least about 15% is produced by (a) pouring a spheroidal graphite cast melt into a casting mold; (b) removing the casting mold by shake-out after the completion of solidification of the melt, while substantially the entire portion of the resulting cast iron product is still at a temperature of its $A_1$ transformation point or higher; (c) when the temperature difference between the surface layer portion and the inner portion has become 40°-60° C., introducing the cast iron product into a uniform-temperature furnace kept at 750°-900° C., where the cast iron product is held for such a time period as to produce the surface layer portion having a ferritization ratio of 70% or more which is larger than that of the inner portion by at least about 15%; and (d) transferring the cast iron product into a cooling furnace to cool the cast iron product at a cooling speed of 15°-100° C./min.

7 Claims, 6 Drawing Sheets

SPHEROIDAL GRAPHITE CAST IRON MEMBER HAVING IMPROVED MECHANICAL STRENGTH HAND METHOD OF PRODUCING SAME

BACKGROUND OF THE INVENTION

The present invention relates to a spheroidal graphite cast iron member and a method of producing it.

Since spheroidal graphite cast iron has excellent mechanical strength and elongation, it is widely used in various applications including automobile parts, machine parts, etc. Specifically, spheroidal graphite cast iron species of FCD 700 and FCD 800 in JIS G5502 are used for parts requiring high mechanical strength, and spheroidal graphite cast iron species of FCD 370 and FCD 400 in JIS G5502 are used for parts requiring large elongation. Further, since important parts of automobiles such as suspension parts are required to have good properties such as tensile strength, elongation, fatigue resistance, impact strength, etc., the spheroidal graphite cast iron constituting such important parts should satisfy the above strength requirements. However, the as-cast surface of the spheroidal graphite cast iron has small unevenness due to contact with mold sand and slag inclusion, and such small unevenness is likely to function as starting points of cracking and failure. Therefore, the spheroidal graphite cast iron having an as-cast surface fails to exhibit its inherent mechanical strength sufficiently.

In such circumstances, the inventors have previously proposed a thin high-strength article of spheroidal graphite cast iron having good mechanical strength (U.S. Pat. No. 4,990,194). Specifically, this thin high-strength article of spheroidal graphite cast iron has graphite particles dispersed in a ferrite matrix containing 10% or less of pearlite, and is characterized in that there are substantially no fine gaps between the graphite particles and the ferrite matrix. Such a thin high-strength article of spheroidal graphite cast iron can be produced by pouring a melt having a spheroidal graphite cast iron composition into a casting mold; removing the casting mold by shake-out after the completion of solidification of the melt, while substantially the entire portion of the resulting cast iron product is still at a temperature of its $A_3$ transformation point or higher; introducing the cast iron product into a uniform temperature zone of a continuous furnace kept at a temperature of the $A_3$ transformation point or higher, where the cast iron product is kept for 30 minutes or less to decompose cementite contained in the matrix; and transferring the cast iron product into a cooling zone of the continuous furnace to cool the cast iron product at such a cooling speed as to conduct the ferritization of the matrix.

However, unlike in the case of the thin articles of spheroidal graphite cast iron, spheroidal graphite cast iron articles having relatively large thickness for use in parts which should satisfy higher mechanical strength requirements should retain a pearlite phase to show good mechanical strength and at the same time should exhibit improved bending strength. For this purpose, the heat treatment of ferritizing the spheroidal graphite cast iron entirely or mostly is not satisfactory.

OBJECT AND SUMMARY OF THE INVENTION

Accordingly, an object of the present invention is to provide a spheroidal graphite cast iron member free from failure-causing points on the as-cast surface thereby showing excellent mechanical properties, particularly elongation.

Another object of the present invention is to provide a method of producing such a spheroidal graphite cast iron member.

In view of the above objects, the inventors of the present invention have found that since the as-cast spheroidal graphite cast iron member has a very hard surface layer portion, the surface unevenness is likely to function as starting points of cracking and breakage, and that to prevent failure due to bending stress, etc. the surface layer portion should be changed to have slightly reduced hardness by a proper heat treatment while substantially retaining the pearlite phase in an inner portion of the spheroidal graphite cast iron member. The present invention has been completed based on this discovery.

Thus, the spheroidal graphite cast iron member according to the present invention has a surface layer portion mostly composed of a ferrite phase and having a thickness of at least 1 mm, and an inner portion composed of a pearlite phase and a ferrite phase, the surface layer portion having a ferritization ratio of 70% or more which is larger than that of the inner portion by at least about 15%.

The first method of producing a spheroidal graphite cast iron member according to the present invention comprises the steps of (a) pouring a melt having a spheroidal graphite cast iron composition into a casting mold; (b) removing the casting mold by shake-out after the completion of solidification of the melt, while substantially the entire portion of the resulting cast iron product is still at a temperature of its $A_1$ transformation point or higher; (c) when the temperature difference between the surface layer portion and the inner portion has become 40°–60° C., introducing the cast iron product into a uniform-temperature furnace kept at a temperature of 750°–900° C., where the cast iron product is held for such a time period as to produce the surface layer portion having a ferritization ratio of 70% or more which is larger than that of the inner portion by at least about 15%; and (d) transferring the cast iron product into a cooling furnace to cool the cast iron product at a cooling speed of 15°–100° C./min.

The second method of producing a spheroidal graphite cast iron member according to the present invention comprises the steps of (a) introducing a pearlitized spheroidal graphite cast iron product into a uniform-temperature furnace kept at a temperature of 780°–870° C., where the cast iron product is held for such a time period as to produce the surface layer portion having a ferritization ratio of 70% or more which is larger than that of the inner portion by at least about 15%; and (b) transferring the cast iron product into a cooling furnace to cool the cast iron product at a cooling speed of 15°–100° C./min.

BRIEF DESCRIPTION OF THE DRAWINGS

FIG. 2(*b*) is a schematic view showing the change of the metal structure of an inner portion of the spheroidal graphite cast iron member by the first method;

FIG. 8(*b*) is a photomicrograph (×100) of the metal structure of an inner portion of a specimen prepared in Example 1;

FIG. 9(*b*) is a photomicrograph (×100) of the metal structure of an inner portion of a speciment prepared in Example 2;

FIG. 10(*b*) is a photomicrograph (×100) of the metal structure of an inner portion of a specimen prepared in Example 3.

DETAILED DESCRIPTION OF THE INVENTION

Figure 1:
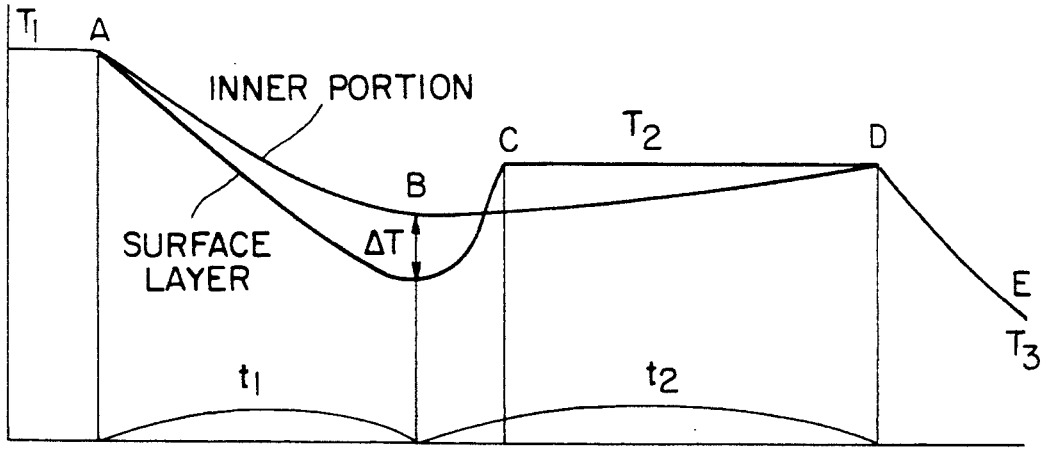
FIG. 1 is a graph showing the first method of the present invention.

The present invention will be described in detail referring to the attached drawings.

[A] Composition of the spheroidal graphite cast iron

The spheroidal graphite cast iron used in the present invention generally has the following chemical composition:

C: 3.40–3.90 weight %,
Si: 1.9–2.5 weight %,
Mn: 0.5 weight % or less,
P: 0.05 weight % or less,
S: 0.02 weight % or less,
Mg: 0.02–0.06 weight %,
Cu: 0.8 weight % or less, and
Fe and inevitable impurities: Balance.

(1) C: 3.40–3.90 weight %

When the amount of C is less than 3.40 weight % or more than 3.90 weight %, the catability of the spheroidal graphite cast iron is reduced.

(2) Si: 1.9–2.5 weight %

When the amount of Si is less than 1.9 weight %, there is a large tendency of forming carbides. On the other hand, when the amount of Si exceeds 2.5 weight %, it is difficult to control the percentage of a pearlite phase, failing to produce a uniform pearlitic structure.

(3) Mn: 0.5 weight % or less

Mn is an element of stabilizing the pearlite phase and forming carbides. The function of stabilizing the pearlite phase is limited when the amount of Mn is more than 0.5 weight %.

(4) P: 0.05 weight % or less

P is an element of hindering the spheroidization of cast iron. Accordingly, the amount of P should not exceed 0.05 weight %.

(5) S: 0.02 weight % or less

S is an element of hindering the spheroidization of cast iron. Accordingly, the amount of S should not exceed 0.02 weight %.

(6) Mg: 0.02–0.06 weight %

When the amount of Mg is less than 0.02 weight %, the yield of forming the spheroidal graphite cast iron is reduced. On the other hand, when the amount of Mg exceeds 0.06 weight %, it is likely that chill is generated.

(7) Cu: 0.8 weight % or less

Cu is an element of stabilizing the pearlite phase without forming carbides. Thus, it functions to form a uniform pearlite phase in the matrix. This function would not be further increased even when the amount of Cu exceeds 0.8 weight %.

The preferred chemical composition of the spheroidal graphite cast iron is as follows:

C: 3.60–3.80 weight %,
Si: 2.0–2.5 weight %,
Mn: 0.4 weight % or less,
P: 0.05 weight % or less,
S: 0.015 weight % or less,
Mg: 0.02–0.05 weight %,
Cu: 0.7 weight % or less, and
Fe and inevitable impurities: Balance.

[B] Layer structure of spheroidal graphite cast iron member (1) Surface layer portion The metal structure of the surface layer portion should have a ferritization ratio of 70% or more. Here, the term "ferritization ratio" means a ratio of a ferrite phase in the matrix. When the ferritization ratio is less than 70%, the surface layer portion does not have a sufficiently reduced hardness, failing to exhibit sufficient effect of preventing the cracking and failure. The preferred ferritization ratio is 80% or more. Incidentally, the remaining phase in the matrix of the surface layer portion is substantially a pearlite phase.

The surface layer portion has a Rockwell hardness HRB of less than 93. When the Rockwell hardness HRB of the surface layer portion is 93 or more, it is likely that surface unevenness (small projections and recesses) of the spheroidal graphite cast iron member may function as starting points of cracking and breakage.

The thickness of the surface layer portion is at least 1 mm. When the thickness of the surface layer portion is less than 1 mm, sufficient effect of preventing the cracking and breakage cannot be achieved. Incidentally, the upper limit of the thickness of the surface layer portion depends on the total thickness of the spheroidal graphite cast iron member, and is generally 10% or less of the total thickness. If the thickness of the surface layer portion exceeds 10% of the total thickness of the spheroidal graphite cast iron member, the spheroidal graphite cast iron member would show reduced mechanical strength.

(2) Inner portion

The metal structure of the inner portion substantially consists of a pearlite phase and a ferrite phase. The ferritization ratio of the inner portion should be smaller than that of the surface layer portion by at least about 15%. When the ferritization ratio of the inner portion is not smaller than that of the surface layer portion by at least about 15% (when the pearlite phase of the inner portion is less than about 45%), the entire body of the spheroidal graphite cast iron member shows insufficient mechanical strength. In general, the ferritization ratio of the inner portion is preferably 0–45%, though it may vary depending on the ferritization ratio of the surface layer portion.

Because of the above structure, the inner portion shows higher Rockwell hardness HRB than the surface layer portion. In general, the Rockwell hardness HRB of the inner portion is higher than that of the surface layer portion by about 10.

Since the spheroidal graphite cast iron member having the above double layer structure has a surface layer portion having a thickness of at least 1 mm, the total thickness of the spheroidal graphite cast iron member is relatively large. Specifically, the total thickness of the spheroidal graphite cast iron member is 12 mm or more, preferably 15 mm or more to obtain good effect.

[C] Method of producing spheroidal graphite cast iron member (1) First method

The first method for producing the spheroidal graphite cast iron member having the above double layer structure comprises subjecting the spheroidal graphite cast iron member to a heat treatment in a uniform-temperature furnace and a cooling furnace shortly after the shake-out. Preferably, a continuous furnace having a uniform-temperature zone and a cooling zone is used. Specifically, the first method comprises the steps of (a) pouring a melt having a spheroidal graphite cast iron composition into a casting mold; (b) removing the casting mold by shake-out after the completion of solidification of the melt, while substantially the entire portion of the resulting cast iron product is still at a temperature of its $A_1$ transformation point or higher; (c) when the temperature difference between the surface layer portion and the inner portion has become 40°–60° C., introducing the cast iron product into a uniform-temperature furnace kept at a temperature of 750°–900° C., where the cast iron product is held for such a time period as to produce the surface layer portion having a ferritization ratio of 70% or more which is larger than that of the inner portion by at least about 15%; and (d) transferring the cast iron product into a cooling furnace to cool the cast iron product at a cooling speed of 15°–100° C./min.

The first method will be explained in detail referring to FIGS. 1 and 2. First, a melt of spheroidal graphite cast iron is cast in a sand mold, and then the shake-out of the casting mold is conducted at a temperature $T_1$ (point A). The shake-out temperature $T_1$ should be an $A_1$ transformation point (about 720° C.) or higher. If the temperature $T_1$ is lower than the $A_1$ transformation point, a subsequent heating step would take a long time, and the heat treatment for a long period of time would reduce the temperature difference between the surface layer portion and the inner portion, resulting in failure to achieve the double layer structure. Specifically, the temperature $T_1$ is preferably 800°–900° C.

After the shake-out, the cast product is left to stand in the air for a short period of time. Since the surface layer portion is subjected to a larger temperature drop than the inner portion until the spheroidal graphite cast iron member is cooled to a point B, there is generated a temperature difference $\Delta T$ between the surface layer portion and the inner portion. This temperature difference $\Delta T$ should be 40°–60° C. If the temperature difference $\Delta T$ is smaller than 40° C., sufficient double layer structure cannot be obtained. On the other hand, if temperature difference $\Delta T$ exceeds 60° C., the temperature of the surface layer portion becomes too low. Incidentally, the temperature of the surface layer portion means a temperature at a surface of the spheroidal graphite cast iron member, and the temperature of the inner portion means a temperature in a center portion of the spheroidal graphite cast iron member. The time $t_1$ required to obtain the temperature difference $\Delta T$ is usually 2–30 minutes, and it may vary within this range depending on the thickness of the spheroidal graphite cast iron member. The preferred time $t_1$ is 5–20 minutes.

The cast product having this temperature difference $\Delta T$ is introduced into a uniform-temperature furnace kept at 750°–900° C. When the temperature of the uniform-temperature furnace is lower than 750° C., the substantial reheating of the cast product is required. On the other hand, if it exceeds 900° C., large energy loss would occur. The preferred heating temperature $T_2$ is 780°–850° C.

In the uniform-temperature furnace at the above temperature, the temperature of the surface layer portion quickly reaches the heating temperature $T_2$ (point C), while the temperature of the inner portion remains at a temperature slightly lower than the heating temperature $T_2$.

Figure 2A:
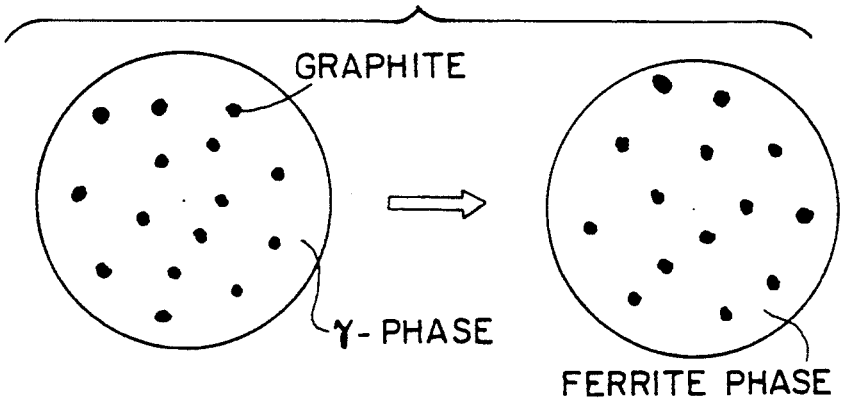
FIG. 2(*a*) is a schematic view showing the change of the metal structure of a surface layer portion of the spheroidal graphite cast iron member by the first method.
Figure 2B:
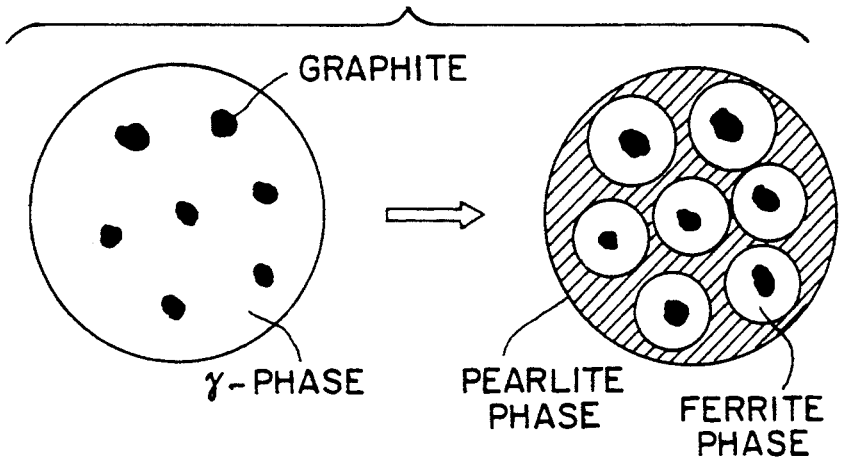

The time $t_2$ for keeping the cast product in the uniform-temperature furnace is determined such that the surface layer portion is provided with a ferritization ratio of 70% or more and that the ferritization ratio of the surface layer portion is larger than that of the inner portion by at least about 15%. The reasons for this limitation are as follows:

As shown in FIG. 2(*a*), since the surface layer portion is relatively rapidly cooled, fine graphite particles are generated, and the matrix becomes a $\gamma$-phase. When the surface layer portion having such a metal structure is kept at a temperature $T_2$, the carbon in the matrix is absorbed into the graphite particles, resulting in the reduction of the carbon content in the matrix. Accordingly, the matrix of the surface layer portion is ferritized by a subsequent slow cooling.

On the other hand, since the inner portion is cooled relatively slowly as compared with the surface layer portion, the graphite particles grows as shown in FIG. 2(*b*). The matrix of the inner portion is also a $\gamma$-phase. When the inner portion having such a metal structure is kept at a temperature slightly lower than the temperature of the surface layer portion, the carbon in the matrix is less absorbed into the graphite particles, resulting in the reduction of the carbon content only in the matrix in the vicinity of the graphite particles. The low-carbon matrix in the vicinity of the graphite particles is ferritized by a subsequent slow cooling. Accordingly, the matrix of the inner portion becomes a mixture of a pearlite phase and a ferrite phase.

After heating at $T_2$, the cast product is transferred to a cooling furnace, where the cast iron product is cooled at a cooling speed of 15°–100° C./min (point D). When the cooling speed is lower than 15° C./minute, the pearlite ratio of the inner portion is reduced. On the other hand, when the cooling speed exceeds 100° C./minute, the pearlite phase tends to remain in the surface layer portion, failing to achieve sufficient softening of the surface layer portion. The preferred cooling speed is 20°–40° C./minute. By this slow cooling, ferritization takes place both in the surface layer portion and in the inner portion, but due to the difference in a metal structure between the surface layer portion and the inner portion the surface layer portion shows a larger ferritization ratio than the inner portion. Incidentally, the slow cooling is not necessary to carry out to a room temperature, but it should be conducted to at least about 650° C. (temperature $T_3$) (point E). At a temperature lower than the $T_3$, the phase transformation does not take place.

By the above heat treatment, the surface layer portion of the spheroidal graphite cast iron member is predominantly ferritized, resulting in the cast product having a double layer structure consisting of a low-hardness surface layer portion and a high-hardness inner portion.

(2) Second method

The second method for producing the spheroidal graphite cast iron member having the above double layer structure comprises the steps of (a) introducing a pearlitized spheroidal graphite cast iron product into a uniform-temperature furnace kept at a temperature of 780°–870° C., where the cast iron product is held for such a time period as to produce the surface layer portion having a ferritization ratio of 70% or more which is larger than that of the inner portion by at least about 15%; and (b) transferring the cast iron product into a cooling furnace to cool the cast iron product at a cooling speed of 15°–100° C./min.

The starting material is a spheroidal graphite cast iron which has been subjected to a pearlitizing treatment. The term "pearlitizing" means treating a spheroidal graphite cast iron member such that it has a pearlite phase. The pearlitized spheroidal graphite cast iron member preferably has a pearlite area ratio of 30% or more. Such a pearlitized spheroidal graphite cast iron member can be produced by conducting a known pearlitizing treatment on a spheroidal graphite cast iron having the above-mentioned composition. The pearlitized spheroidal graphite cast iron member has a surface layer portion in which graphite particles are finely dispersed and an inner portion in which graphite particles are large.

Figure 3:
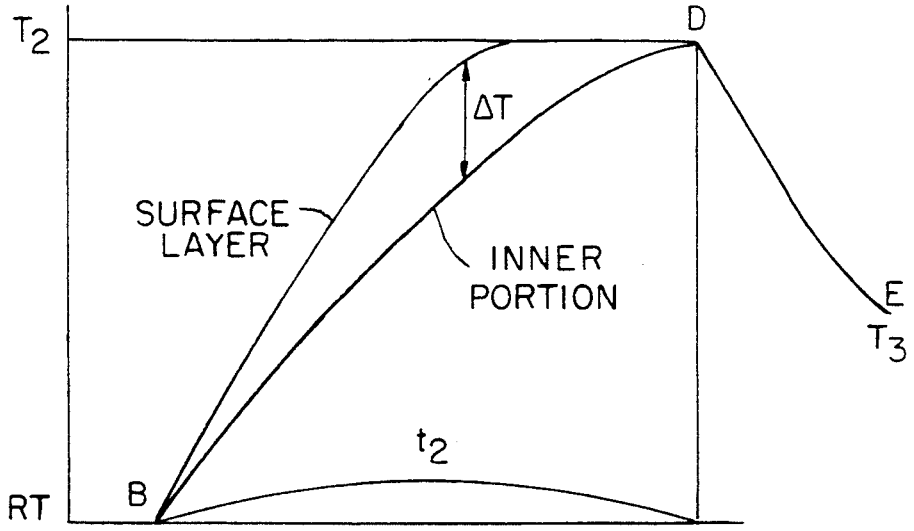
FIG. 3 is a graph showing the second method of the present invention.

The second method will be explained in detail referring to FIG. 3. First, the pearlitized spheroidal graphite cast iron member is introduced into a uniform-temperature furnace kept at 780°–870° C. (point B), where the cast iron product is held for such a time period as to produce the surface layer portion having a ferritization ratio of 70% or more which is larger than that of the inner portion by at least about 15%. When the temperature of the uniform-temperature furnace is lower than 780° C., it is difficult to diffuse C in the matrix in order to achieve a uniform metal structure. On the other hand, if it exceeds 870° C., the influence of the heat treatment reaches the inner portion, making it difficult to control the formation of the double layer structure. The preferred heating temperature is 800°–850° C.

The time $t_2$ for keeping the cast product in the uniform-temperature furnace is determined such that the surface layer portion is provided with a ferritization ratio of 70% or more and that the ferritization ratio of the surface layer portion is larger than that of the inner portion by at least about 15%. During the heat treatment, the surface layer portion is relatively rapidly heated, the temperature of the surface layer portion becomes higher than that of the inner portion by $\Delta T$. Accordingly, the carbon in the matrix of the surface layer portion is absorbed into the graphite particles, resulting in the reduction of the carbon content in the matrix of the surface layer portion. Accordingly, the matrix of the surface layer portion is ferritized by a subsequent slow cooling.

On the other hand, since the inner portion is heated relatively slowly as compared with the surface layer portion, the carbon in the matrix of the inner portion is less absorbed into the graphite particles, resulting in the reduction of the carbon content only in the matrix of the inner portion in the vicinity of the graphite particles. The low-carbon matrix in the vicinity of the graphite particles is ferritized and the other portion of the matrix is pearlitized by a subsequent slow cooling. Accordingly, the matrix of the inner portion becomes a mixture of a pearlite phase and a ferrite phase.

The time $t_2$ of heating the cast product is usually 2–30 minutes, and it may vary within this range depending on the thickness of the spheroidal graphite cast iron member. The preferred time $t_2$ is 5–20 minutes.

After heating at $T_2$, the cast product is transferred to a cooling furnace, where the cast iron product is cooled at a cooling speed of 15°–100° C./min (point D). The reasons for limiting the cooling speed are the same as mentioned above. The slow cooling is not necessary to carry out to a room temperature, but it should be conducted to at least about 650° C. (temperature $T_3$) (point E).

By the above heat treatment, the surface layer portion of the spheroidal graphite cast iron member is predominantly ferritized, resulting in the cast product having a double layer structure consisting of a low-hardness surface layer portion and a high-hardness inner portion, as in the first method.

Figure 4:
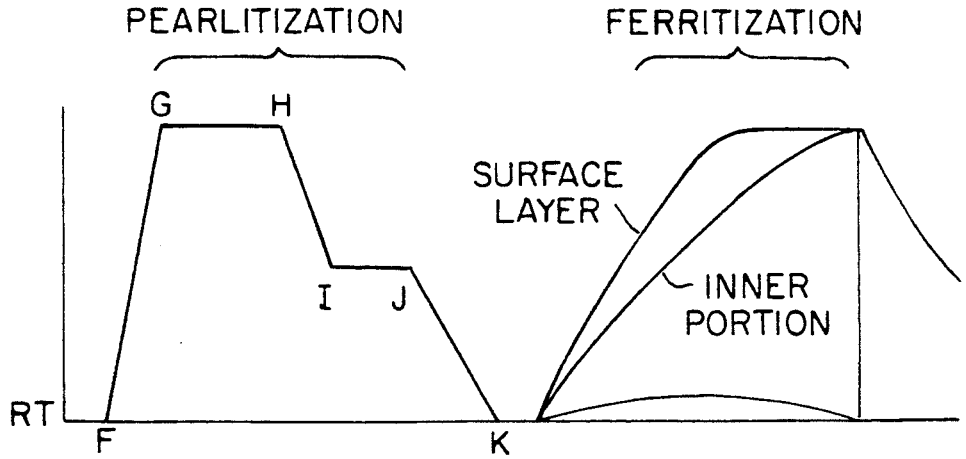
FIG. 4 is a graph showing the second method of the present invention, which is preceded by a pearlitization treatment step.

FIG. 4 shows a temperature pattern for conducting a pearlitizing treatment prior to the second method. The pearlitizing treatment comprises an austenitizing treatment in a step G-H at 840°–860° C. for 0.5–2 hours, a homogenizing treatment in a step I-J at 780°–820° C. for 0.5–1 hours, and a forced cooling.

The present invention will be described in further detail by the following Examples.

Example 1, Comparative Examples 1–2

(1) Composition

Figure 5:
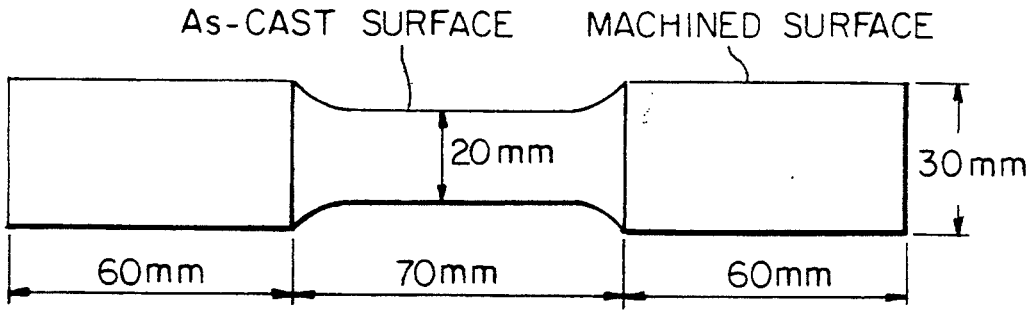
FIG. 5 is a side view showing a specimen of the spheroidal graphite cast iron which is to be subjected to a tensile test.
Figure 6:
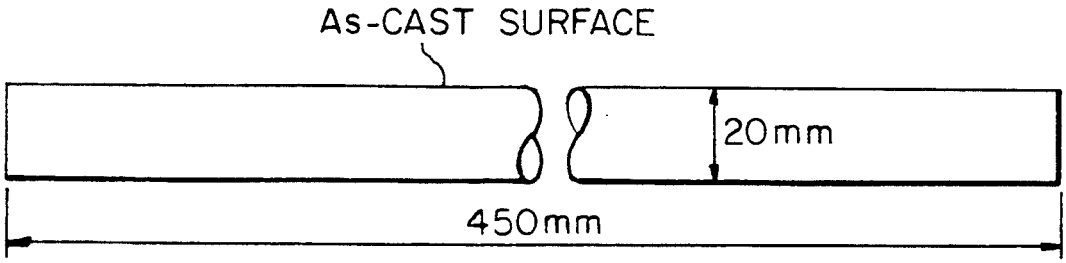
FIG. 6 is a partially broken side view showing a speciment of the spheriodal graphite cast iron which is to be subjected to a bending test and a bending impact test.
Figure 7:
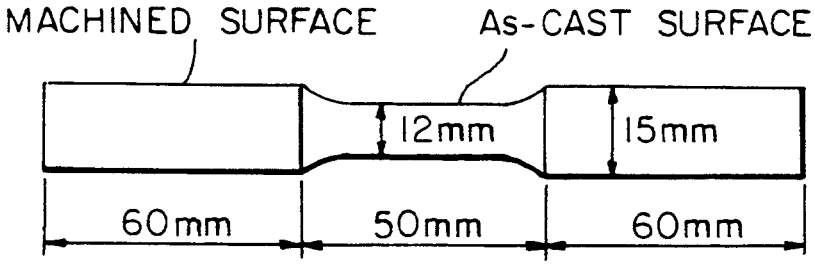
FIG. 7 is a side view showing a specimen of the spheroidal graphite cast iron which is to be subjected to a rotation bending fatigue test.

A cast iron material having a composition consisting of iron, inevitable impurities and the following components shown in Table 1, first column was used to produce specimens shown in FIGS. 5–7.

TABLE 1

| No. | Example 1(1) | Comparative Example 1(2) | Weight % Comparative Example 2(3) |
|---|---|---|---|
| C | 3.68 | 3.71 | 3.60 |
| Si | 2.26 | 2.40 | 2.40 |
| Mn | 0.31 | 0.21 | 0.30 |
| P | 0.035 | 0.021 | 0.022 |
| S | 0.011 | 0.007 | 0.008 |
| Mg | 0.037 | 0.035 | 0.031 |
| Cu | 0.56 | 0.18 | 0.52 |

Note:
(1)The present invention.
(2)FCD 45.
(3)FDC 60.

(2) Heat treatment

A spheroidal graphite cast iron melt having the above composition was poured into a sand mold at 1410° C., and the mold was removed by shake-out while the above specimen was still at a temperature higher than the $A_1$ transformation point (about 720° C.). Just after passing a time period in which the temperature difference $\Delta T$ between the surface layer portion and the inner portion became 50° C. (5 minutes), the cast product was introduced into a uniform-temperature zone of a continuous furnace kept at 830° C. and held therein for 15 minutes. After that, it was transferred into a cooling zone of the continuous furnace, where it was cooled to 650° C. at a cooling speed of 55° C./min and then discharged from the furnace.

Figure 8A:
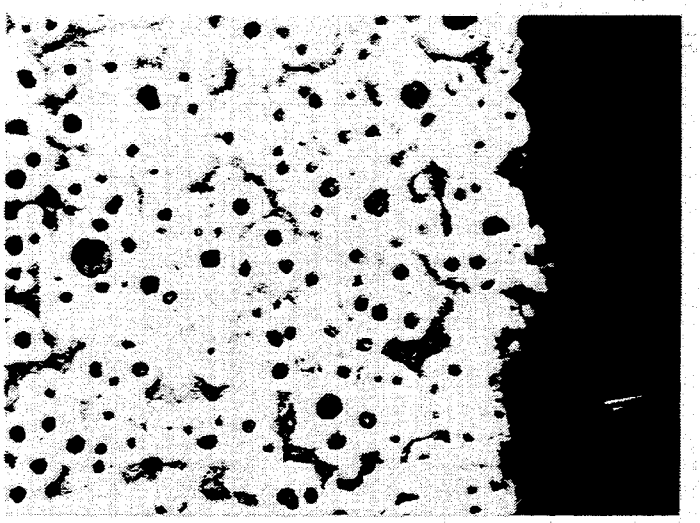
FIG. 8(*a*) is a photomicrograph (×100) of the metal structure of a surface layer portion of a specimen prepared in Example 1.
Figure 8B:
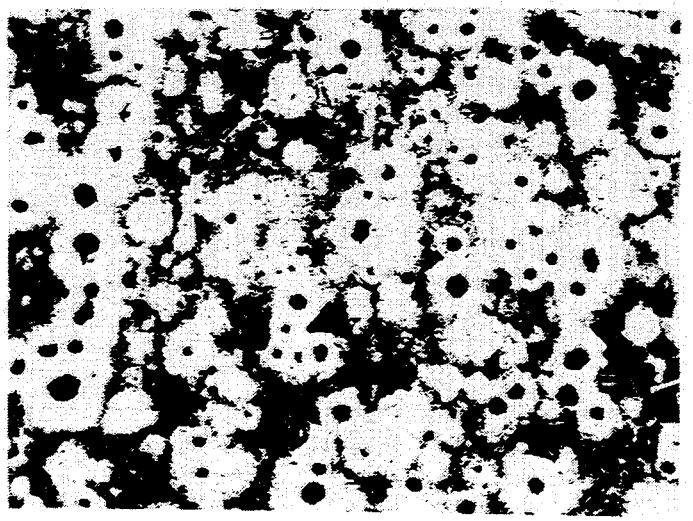

With respect to the specimen as shown in FIG. 6, electron micrographic observation was conducted. The photomicrograph (×100) of a surface layer portion of the specimen is shown in FIG. 8(*a*), and the photomicrograph (×100) of an inner portion of the specimen is shown in FIG. 8(*b*). From each photomicrograph, ferritization ratios of the surface layer portion and the inner portion were determined.

Also, specimens having the same shapes as those of Example 1 were produced from alloy compositions shown in Table 1 (Comparative Example 1 and 2). However, only a conventional pearlitizing treatment (conditions: 850° C.×1 hour, homogenization at 780°–820° C., and forced cooling) was conducted on the specimens in Comparative Examples 1 and 2.

(3) Measurement (a) Tensile test

Using a specimen shown in FIG. 5 (an as-cast surface was retained in a measured portion, and the other portion was machined), a tensile strength ($\sigma_B$), a load at 0.2% proof stress ($\sigma_{0.2}$) and elongation ($\delta$) were measured.

(b) Bending test

A load was applied to a specimen shown in FIG. 6 (an as-cast surface was retained in all area) supported by two points apart from each other by 300 mm, to obtain a relation between a bending load and a bending deformation.

Also, a weight of 50 kg was dropped from a height of 10 cm onto a specimen shown in FIG. 6 (an as-cast surface was retained in all area) supported by two points apart from each other by 100 mm. Under this condition, the height of the weight was elevated by every 10 cm until cracking was generated in the specimen. From the height of the weight at which cracking was generated in the specimen, a bending impact strength was obtained with respect to the specimen.

(c) Fatigue test

Using a specimen shown in FIG. 7 (an as-cast surface was retained in a measured portion, and the other portion was machined), a fatigue limit was measured by an Ono-type, rotation-bending fatigue test machine under the conditions of room temperature, constant load, in the air and at 3600 rpm. The fatigue limit was expressed by a largest stress with which the specimen was not broken (not cracked, or cracking, if any, did not propagate) after $10^7$ repetition.

The measurement results are shown in Table 4.

Example 2

(1) Composition

A cast iron material having a composition consisting of iron, inevitable impurities and the following components shown in Table 2 was used to produce the same specimens as in Example 1.

TABLE 2

| Example No. | Weight % | | | | | | |
|---|---|---|---|---|---|---|---|
| | C | Si | Mn | P | S | Mg | Cu |
| 2 | 3.73 | 2.24 | 0.35 | 0.02 | 0.009 | 0.033 | 0.45 |

(2) Heat treatment

A spheroidal graphite cast iron melt having the above composition was poured into a sand mold at 1420° C., and the mold was removed by shake-out, and pearlitizing treatment was conducted, followed by cooling to room temperature. The resulting cast products having shapes of specimens shown in FIGS. 5–7 were introduced into a uniform-temperature furnace kept at 800° C. and held therein for 5 minutes. After that, they were transferred into a cooling furnace, where they were cooled to 200° C. at a cooling speed of 20° C./min and then discharged from the furnace.

Figure 9A:
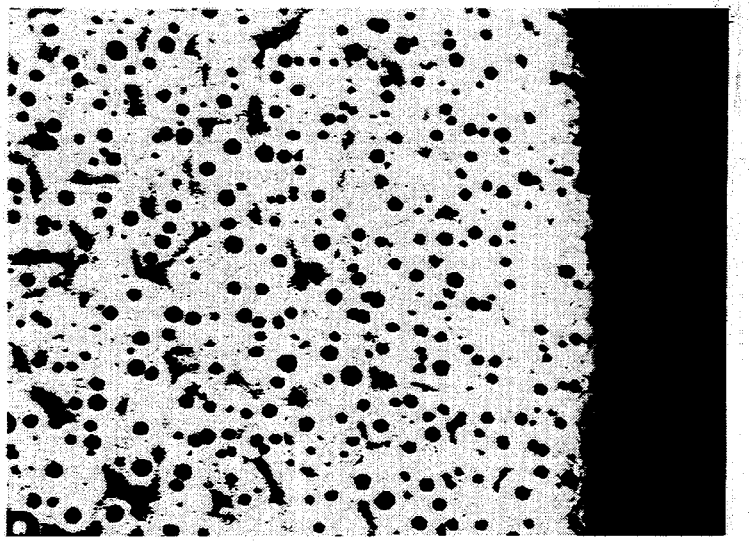
FIG. 9(*a*) is a photomicrograph (×100) of the metal structure of a surface layer portion of a specimen prepared in Example 2.
Figure 9B:
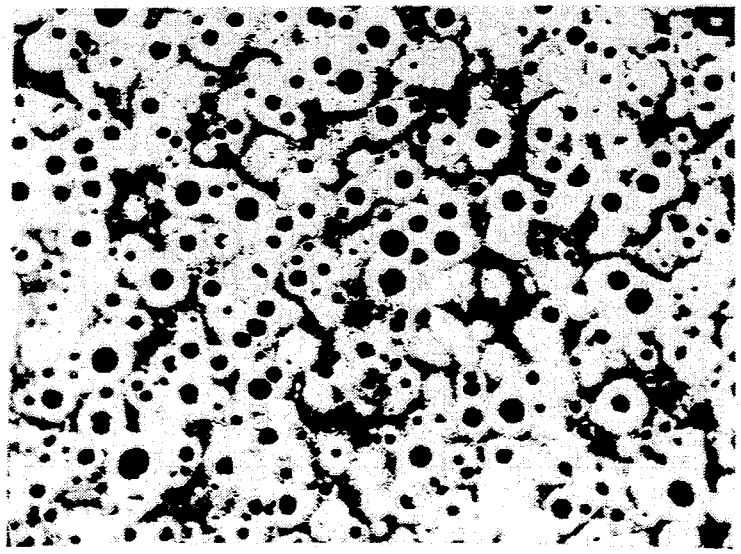

With respect to the specimen shown in FIG. 6, electron micrographic observation was conducted. The photomicrograph (×100) of a surface layer portion of the specimen is shown in FIG. 9(*a*), and the photomicrograph (×100) of an inner portion of the specimen is shown in FIG. 9(*b*). From each photomicrograph, ferritization ratios of the surface layer portion and the inner portion were determined. Also, the same mechanical strength tests as in Example 1 were conducted. The results are shown in Table 4.

EXAMPLE 3

(1) Composition

A cast iron material having a composition consisting of iron, inevitable impurities and the following components shown in Table 3 was used to produce the same specimens as in Example 1.

TABLE 3

| Example No.* | Weight % | | | | | | |
|---|---|---|---|---|---|---|---|
| | C | Si | Mn | P | S | Mg | Cu |
| 3 | 3.70 | 2.21 | 0.30 | 0.021 | 0.008 | 0.038 | 0.08 |

(2) Heat treatment

A spheroidal graphite cast iron melt having the above composition was poured into a sand mold at 1415° C., and the mold was removed by shake-out, to take out cast products having shapes of specimens shown in FIGS. 5–7 which were then cooled to room temperature. The cast products were introduced into a heat treatment furnace at 850° C. and held therein for 60 minutes. They were then introduced into a furnace at 810° C. and held therein for 1 hour. After taking out the cast product from the furnace, they were forcibly cooled to obtain pearlitized cast products.

Each of the resulting pearlitized cast products was introduced into a uniform-temperature furnace kept at 810° C. and held therein for 5 minutes. They were then transferred into a cooling furnace, where they were cooled to 200° C. at a cooling speed of 20° C./min and then discharged from the furnace.

Figure 10A:
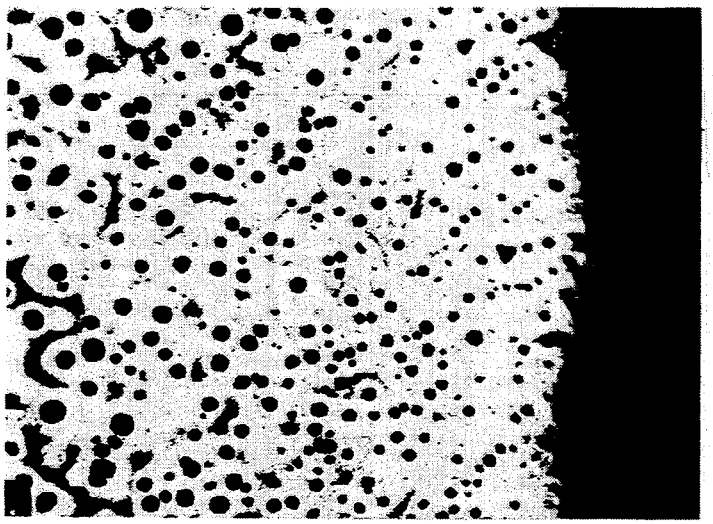
FIG. 10(*a*) is a photomicrograph (×100) of the metal structure of a surface layer portion of a specimen prepared in Example 3.
Figure 10B:
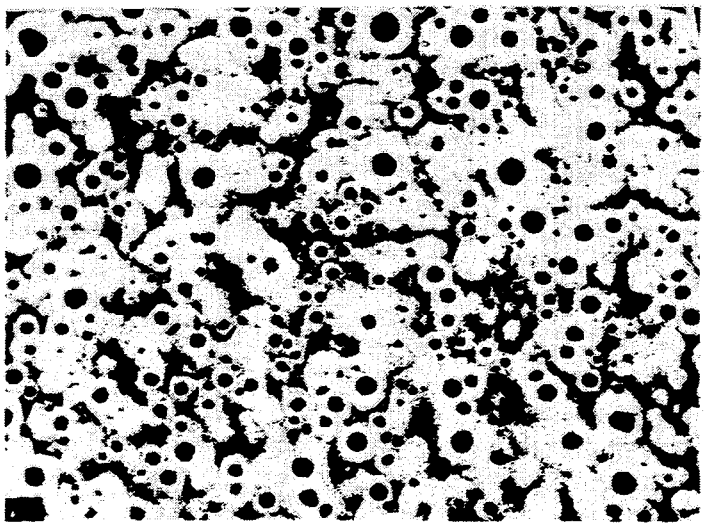

With respect to the specimen shown in FIG. 6, electron micrographic observation was conducted. The photomicrograph (×100) of a surface layer portion of the speciment is shown in FIG. 10(*a*), and the photomicrograph (×100) of an inner portion of the specimen is shown in FIG. 10(*b*). From each photomicrograph, ferritization ratios of the surface layer portion and the inner portion were determined. Also, the same mechanical strength tests as in Example 1 were conducted. The results are shown in Table 4.

TABLE 4

| Specimen | | Tensile Test | | | Ferritization ratio (%)(1) | |
|---|---|---|---|---|---|---|
| | | $\sigma_B$(2) | $\sigma_{0.2}$(2) | $\delta$(3) | Surface(4) | Inner(5) |
| Example 1 | 1 | 64.8 | 43.6 | 6.6 | 82 | 47 |
| | 2 | 64.0 | 42.4 | 5.7 | | |
| | 3 | 67.7 | 43.8 | 7.5 | | |
| Example 2 | 1 | 65.5 | 43.8 | 7.2 | 90 | 75 |
| | 2 | 64.1 | 42.9 | 6.5 | | |
| | 3 | 63.7 | 44.2 | 5.9 | | |
| Example 3 | 1 | 60.5 | 42.5 | 7.3 | 87 | 68 |
| | 2 | 59.3 | 41.8 | 6.9 | | |
| | 3 | 61.4 | 39.6 | 7.6 | | |
| Comparative Example 1 | 1 | 54.9 | 41.0 | 4.8 | 73 | 76 |
| | 2 | 53.0 | 40.7 | 4.9 | | |
| | 3 | 52.7 | 39.9 | 4.2 | | |
| Comparative Example 2 | 1 | 62.7 | 44.1 | 2.2 | 42 | 40 |
| | 2 | 63.5 | 43.8 | 3.4 | | |
| | 3 | 62.7 | 43.6 | 2.8 | | |

| | | Bending Test | |
|---|---|---|---|
| | | Load (kg) | Deformation (mm) |
| Example 1 | 1 | 1295 | 65 |
| | 2 | 1300 | 60 |
| | 3 | 1290 | 62 |
| Example 2 | 1 | 1320 | 64 |
| | 2 | 1310 | 61 |
| | 3 | 1280 | 62 |
| Example 3 | 1 | 1300 | 61 |
| | 2 | 1310 | 62 |
| | 3 | 1300 | 65 |
| Comparative Example 1 | 1 | 1150 | 22 |
| | 2 | 1100 | 20 |
| | 3 | 1150 | 23 |
| Comparative Example 2 | 1 | 1360 | 15 |
| | 2 | 1300 | 15 |
| | 3 | 1330 | 12 |

| | | Bending Impact Strength (kgf-m) | Fatigue Limit (kg/mm²)(1) |
|---|---|---|---|
| Example 1 | 1 | 30 | 19 |
| | 2 | 30 | |
| | 3 | 30 | |
| Example 2 | 1 | 30 | 18 |
| | 2 | 30 | |
| | 3 | 25 | |
| Example 3 | 1 | 25 | 16 |
| | 2 | 30 | |
| | 3 | 25 | |
| Comparative Example 1 | 1 | 20 | 16 |
| | 2 | 20 | |
| | 3 | 25 | |
| Comparative Example 2 | 1 | 20 | 17 |
| | 2 | 15 | |
| | 3 | 20 | |

Note:
(1)Average value of data obtained from three specimens 1–3.
(2)Unit: kg/mm².
(3)Unit: %
(4)Surface layer portion.
(5)Inner portion.

It is clear from Table 4 that the spheroidal graphite cast iron specimens of the present invention (Examples 1–3) are superior to FCD 45 (Comparative Example 1) and FCD 60 (Comparative Example 2) with respect to any of tensile strength, elongation, bending strength, bending impact strength and fatigue limit.

Figure 11:
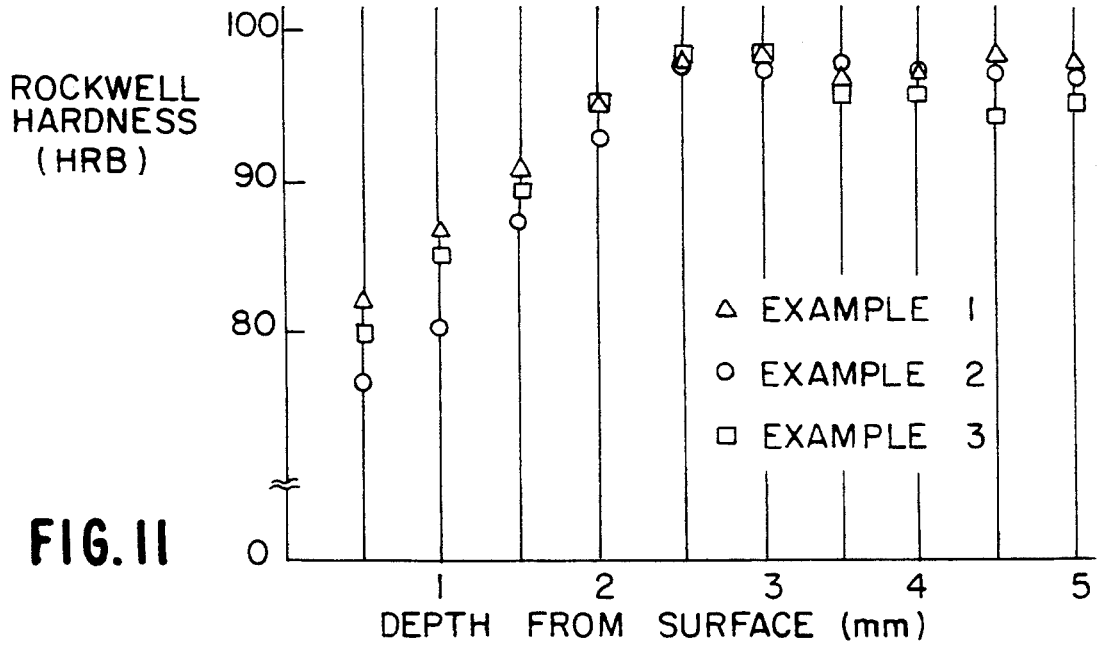
FIG. 11 is a graph showing the relation between Rockwell hardness HRB and a depth from a surface of each speciment prepared in Examples 1-3.

With respect to the specimens of Examples 1–3 (having a shape shown in FIG. 6), Rockwell hardness HRB was measured at each depth from the surface. The relation of the Rockwell hardness HRB and the depth from the surface is shown in FIG. 11. FIG. 11 indicates that the Rockwell hardness HRB gradually increased up to the depth of about 2.5 mm. Therefore, it was confirmed that a surface layer portion was formed in a thickness of about 2.5 mm in each specimen.

As described above in detail, since the spheroidal graphite cast iron member of the present invention has a surface layer portion having slightly decreased hardness and improved elongation, it can show excellent mechanical strength as a whole. Such spheroidal graphite cast iron member having high mechanical strength are suitable for parts required to have good strength and toughness and likely to be used without removing as-cast surfaces, for instance, parts for suspension parts of automobiles, joints for connecting steel reinforcements, base members for fixing steel columns of buildings, etc.

What is claimed is:

1. A spheroidal graphite cast iron member having two outer surface layer portions, each mostly composed of a ferrite phase and having a thickness of at least 1 mm, and an inner portion composed of a pearlite phase and a ferrite phase each of said surface layer portions having a ferritization ratio of 70% or more which is larger than that of said inner portion by at least about 15%.

2. The spheroidal graphite cast iron member according to claim 1, wherein each of said surface layer portions has a Rockwell hardness HRB of 93 or less, and the Rockwell hardness HRB of each of said surface layer portions is lower than that of said inner portion.

3. The spheroidal graphite cast iron member according to claim 1, wherein said spheroidal graphite cast iron has a composition consisting essentially of 3.40–3.90 weight % of C, 1.9–2.5 weight % of Si, 0.5 weight % or less of Mn, 0.05 weight % or less of P, 0.02 weight % or less of S, 0.02–0.06 weight % of Mg and 0.8 weight % or less of Cu, the balance being substantially Fe and inevitable impurities.

4. A method of producing a spheroidal graphite cast iron member having two outer surface layer portions mostly composed of a ferrite phase and having a thickness of at least 1 mm, and an inner portion composed of a pearlite phase and a ferrite phase, each of said surface layer portions having a ferritization ratio of 70% or more which is larger than that of said inner portion by at least about 15%, comprising the steps of (a) pouring a melt having a spheroidal graphite cast iron composition into a casting mold; (b) removing said casting mold by shake-out after the completion of solidification of said melt, while substantially the entire portion of the resulting cast iron product is still at a temperature of its $A_1$ transformation point or higher; (c) when the temperature difference between each of said surface layer portions and said inner portion has become 40°–60° C., introducing said cast iron product into a uniform-temperature furnace kept at a temperature of 750°–900° C., where said cast iron product is held for such a time period as to produce each of said surface layer portions having a ferritization ratio of 70% or more which is larger than that of said inner portion by at least about 15% ; and (d) transferring said cast iron product into a cooling furnace to cool said cast iron product at a cooling speed of 15°–100° C./min.

5. The method according to claim 4, wherein said spheroidal graphite cast iron has a composition consisting essentially of 3.40–3.90 weight % of C, 1.9–2.5 weight % of Si, 0.5 weight % or less of Mn, 0.05 weight % or less of P, 0.02 weight % or less of S, 0.02–0.06 weight % of Mg and 0.8 weight % or less of Cu, the balance being substantially Fe and inevitable impurities.

6. A method of producing a spheroidal graphite cast iron member having two outer surface layer portions mostly composed of a ferrite phase and having a thickness of at least 1 mm, and an inner portion composed of a pearlite phase and a ferrite phase, each of said surface layer portions having a ferritization ratio of 70% or more which is larger than that of said inner portion by at least about 15%, comprising the steps of (a) introducing a pearlitized spheroidal graphite cast iron product into a uniform-temperature furnace kept at a temperature of 780°–870° C., where said cast iron product is held for such a time period as to produce each of said surface layer portions having a ferritization ratio of 70% or more which is larger than that of said inner portion by at least about 15%; and (b) transferring said cast iron product into a cooling furnace to cool said cast iron product at a cooling speed of 15°–100° C./min.

7. The method according to claim 6, wherein said spheroidal graphite cast iron has a composition consisting essentially of 3.40–3.90 weight % of C, 1.9–2.5 weight % of Si, 0.5 weight % or less of Mn, 0.05 weight % or less of P, 0.02 weight % or less of S, 0.02–0.06 weight % of Mg and 0.8 weight % or less of Cu, the balance being substantially Fe and inevitable impurities.

* * * * *